US010226677B2

(12) United States Patent
Parsons

(10) Patent No.: US 10,226,677 B2
(45) Date of Patent: Mar. 12, 2019

(54) ENCLOSED MINIATURE DISC-GOLF COURT AND METHOD OF PLAY

(71) Applicant: Kevin Parsons, Great Barrington, MA (US)

(72) Inventor: Kevin Parsons, Great Barrington, MA (US)

( * ) Notice: Subject to any disclaimer, the term of this patent is extended or adjusted under 35 U.S.C. 154(b) by 0 days.

(21) Appl. No.: 15/813,527

(22) Filed: Nov. 15, 2017

(65) Prior Publication Data

US 2018/0178099 A1 Jun. 28, 2018

Related U.S. Application Data

(60) Provisional application No. 62/437,999, filed on Dec. 22, 2016.

(51) Int. Cl.
*A63B 67/06* (2006.01)
*A63F 9/02* (2006.01)

(52) U.S. Cl.
CPC ..... *A63B 67/06* (2013.01); *A63F 9/0204* (2013.01); *A63F 2009/0286* (2013.01)

(58) Field of Classification Search
CPC ..... A63B 67/06
USPC ..... 273/398–402; 473/169, 471
See application file for complete search history.

(56) References Cited

U.S. PATENT DOCUMENTS 2,894,749 A * 7/1959 Rook ..... A63B 69/3691 472/92
3,880,427 A * 4/1975 Bingham ..... A63B 24/0021 273/402
4,984,809 A * 1/1991 Chiang ..... A63B 63/00 273/401
5,048,845 A * 9/1991 Dunipace ..... A63B 67/06 273/400
5,203,566 A * 4/1993 Ricigliano ..... A63B 67/02 473/158
5,944,318 A * 8/1999 Payton ..... A63B 63/00 273/402
6,843,478 B1 * 1/2005 Hoepelman ..... A63B 63/00 273/342
8,827,845 B1 * 9/2014 Griffin ..... A63B 63/00 273/400
8,967,624 B1 * 3/2015 Ingle ..... A63B 67/02 273/400
2003/0227137 A1 * 12/2003 Girard ..... A63B 67/007 273/404
2008/0111312 A1 * 5/2008 Longo ..... A63B 67/06 273/402

(Continued)

*Primary Examiner* — Mark Graham
(74) *Attorney, Agent, or Firm* — Jason DeFrancesco

(57) ABSTRACT

An enclosed disc-golf court (10) with multiple holes (24). Each hole has a disc throwing lane (32) between a tee-off area (26) and a target basket (30). Boundary walls (36) on each side of the lane extend from a floor (14) to or near a roof (16). At least one hole has an obstacle (52A-M) partially blocking the lane. A player attempts to manually throw a disc (28) through an unblocked area (56, 60) in or beside the obstacle to hit the target basket. At least one target basket may have a sheath (62) that blocks entry of the disc except through a disc-access hole (66) in the sheath. A player can try repeatedly from where the disc lands after each throw until it enters the target basket up to a maximum number of tries per hole. The lowest score among multiple players wins a round.

15 Claims, 4 Drawing Sheets

(56) References Cited

U.S. PATENT DOCUMENTS

| | | | | |
|---|---|---|---|---|
| 2011/0156351 | A1* | 6/2011 | Stanley | A63B 63/00 273/400 |
| 2014/0145401 | A1* | 5/2014 | Powers | A63B 67/06 273/402 |
| 2014/0183823 | A1* | 7/2014 | Deming | A63B 67/06 273/371 |
| 2014/0265137 | A1* | 9/2014 | Gradinger | A63B 67/06 273/400 |
| 2015/0367216 | A1* | 12/2015 | Todd | A63B 67/06 273/400 |
| 2016/0121186 | A1* | 5/2016 | Sciandra | A63B 67/06 273/350 |

* cited by examiner

ENCLOSED MINIATURE DISC-GOLF COURT AND METHOD OF PLAY

CROSS-REFERENCE TO RELATED APPLICATIONS

This application claims benefit of the Dec. 22, 2016 filing date of application 62/437,999 which is incorporated by reference herein.

FIELD OF THE INVENTION

This disclosure relates the game of disc-golf and in particular relates to a new miniature disc-golf game played within an outdoor or indoor enclosure.

BACKGROUND OF THE INVENTION

Disc-golf is one of the fastest growing sports of the past 10-15 years. Disc-golf is played in a manner similar to traditional golf, but instead of striking a golf ball with a series of clubs from a tee-off area, along a fairway and to a putting green and into a cup, a player of disc-golf, with a hand-throw, flies a disc from a tee-off area toward a target that is generally in the form of a "target-basket". The target-basket may be 250 to 450 feet away from the tee-off area. The player's first throw seeks to place the disc as close as possible to the target-basket, and the next several throws seek to have the disc come to rest within the target-basket. Disc-golf provides for delightful social interchange between players with a competitive component, and at a fraction of the cost of traditional golf. Folks have a lot of fun while playing this rapidly growing sport.

U.S. Pat. No. 5,921,551 that issued on Jul. 13, 1999 to Dunipace shows a typical disc-golf target-basket that includes a center post, a lower basket on the center post, an upper basket positioned above the lower basket. An upside-down cone-shaped chain rack extends from a perimeter of the upper basket toward a center of the lower basket. As a disc impacts the chain rack, the disc stops its horizontal motion and drops into the lower basket to complete the playing of a hole. U.S. Pat. No. 7,500,675 that issued on Mar. 10, 2009 to Sandman, shows an improved "Portable Disc Golf Target", wherein a similar light weight cord rack utilizes a weighted ring at a bottom of the rack to reduce overall weight, and includes collapsible support features to make it easy to move the target. Sandman also claims "a portable flying disc game" that is typical of outdoor, big disc golf.

Such big disc-golf requires many acres for outdoor playing on a disc-golf course and requires a substantial level of skill gained by repeated playing of big disc-golf games. Because the game is played virtually always outdoors, players are unable to play in northern climates during winter season and other periods of inclement weather. Additionally, the cost of acquiring and maintaining a sufficient land area for a big disc golf course limits access to and growth of traditional big disk golf courses.

Accordingly, there is a need for a disc-golf game and related equipment that provides an opportunity for players to engage in an entertaining, competitive sport that provides for social interchange, that can be played indoors or outdoors, in daylight or after sunset, that can be enjoyed by highly experienced disc-golf players as well as by players that are brand new to the game, and that can also act as an introduction to disc-golf for new players.

SUMMARY OF THE INVENTION

The disclosure is an enclosed miniature disc-golf court for playing a miniature disc-golf game. The enclosed miniature disc-golf court includes an enclosed court having a floor and a ceiling overlying the floor. At least three walls or an endless loop wall extend between perimeter edges of the floor and the ceiling to thereby define an enclosure between the floor the ceiling and the at least three walls or the endless loop wall. A plurality of disc-golf holes are defined within the enclosure. Each disc-golf hole includes a tee-off area for launching a disc, a target-basket for receiving a disc, and a lane defined between the tee-off area and the target-basket so that a player flies the disc from the tee-off area and along the lane toward the target-basket. Also, within the enclosure, each disc-golf hole is separated from each other disc-golf hole by boundary walls extending from the floor to at least eighty percent of a distance from the floor to the ceiling. The boundary walls are configured to prevent passage of a disc through the boundary walls.

In an exemplary miniature disc-golf course, the walls of the enclosure may be made of semi-rigid fencing, especially for outdoor usage, while the ceiling and boundaries may be formed from flexible netting material. The disclosure also includes the walls, floor, ceiling and boundaries that are made of any material that will permit playing the game of miniature disc-golf as described herein.

In a specific embodiment, the enclosed miniature disc-golf court also includes a circular target pad secured adjacent the floor and between a base of the target-basket and the floor. The target-basket is secured to, or rests upon a middle of the circular target pad. The circular target pad has a diameter that is between about four times and about six times a largest horizontal diameter of the target-basket.

In another embodiment of the enclosed miniature disc-golf court, the tee-off area is a circular tee-off area having a diameter that about the same as a largest horizontal diameter of the target-basket.

In a further embodiment of the enclosed miniature disc-golf court, at least one of the plurality of disc-golf holes includes an obstacle positioned within the lane between the tee-off area and the target-basket. Instead of the big disc-golf game of having a long distance be a challenge to players, the present miniature disc-golf game utilizes obstacles in some or all of the disc-golf holes. The obstacles block passage of the disc through between about fifty percent and about ninety-five percent of an area of a vertical cross-section of the lane. The obstacle leaves an unblocked area for passage of the disc having an opening area greater than about two times an area of a vertical cross-section of the disc. In a further aspect of the enclosed miniature disc-golf court, the obstacles may define either a single passageway through and/or around the obstacle or a plurality of passageways through and/or around the obstacle.

In another aspect of the enclosed miniature disc-golf court, the target-basket includes a disc-access sleeve surrounding a chain rack area of the target-basket. The disc-access sleeve defines a plurality of disc-access through-passages, and each of the disc-access through-passages defines an unobstructed entry opening configured to permit passage of the disc through the unobstructed entry opening so that a disc passing through the unobstructed entry opening is captured within the target-basket to complete playing of a hole by the player that directed the disk through the unobstructed entry passage. Also, each of the unobstructed entry openings defines an area greater than between about one-hundred and fifty percent and about two-hundred percent of a vertical cross-section of the disc.

In particular embodiment of the enclosed miniature disc-golf court, nine or eighteen disc-golf holes are defined within the enclosure.

In another aspect of the enclosed miniature disc-golf court, at least twelve of the disc-golf holes include an obstacle positioned within the lane between the tee-off area and the target-basket. Each of the obstacles block passage of the disc through between about fifty percent and about ninety-five percent of an area of a vertical cross-section of the lane. The about ninety-five percent of the area of the vertical cross-section of the lane defines a remaining unblocked area for passage of the disc along the lane, the unblocked area having an opening greater than about two times an area of a vertical cross-section of the disc.

In a preferred embodiment of the enclosed miniature disc-golf court, the area of the floor of the enclosed miniature disc-golf court is at least about seven thousand square feet and optionally greater than about seven thousand square feet.

For purposes herein, the word "about" is to mean plus or minus twenty percent.

BRIEF DESCRIPTION OF THE DRAWINGS

The invention is explained in the following description in view of the drawings that show.

DETAILED DESCRIPTION OF THE INVENTION

Figure 1:
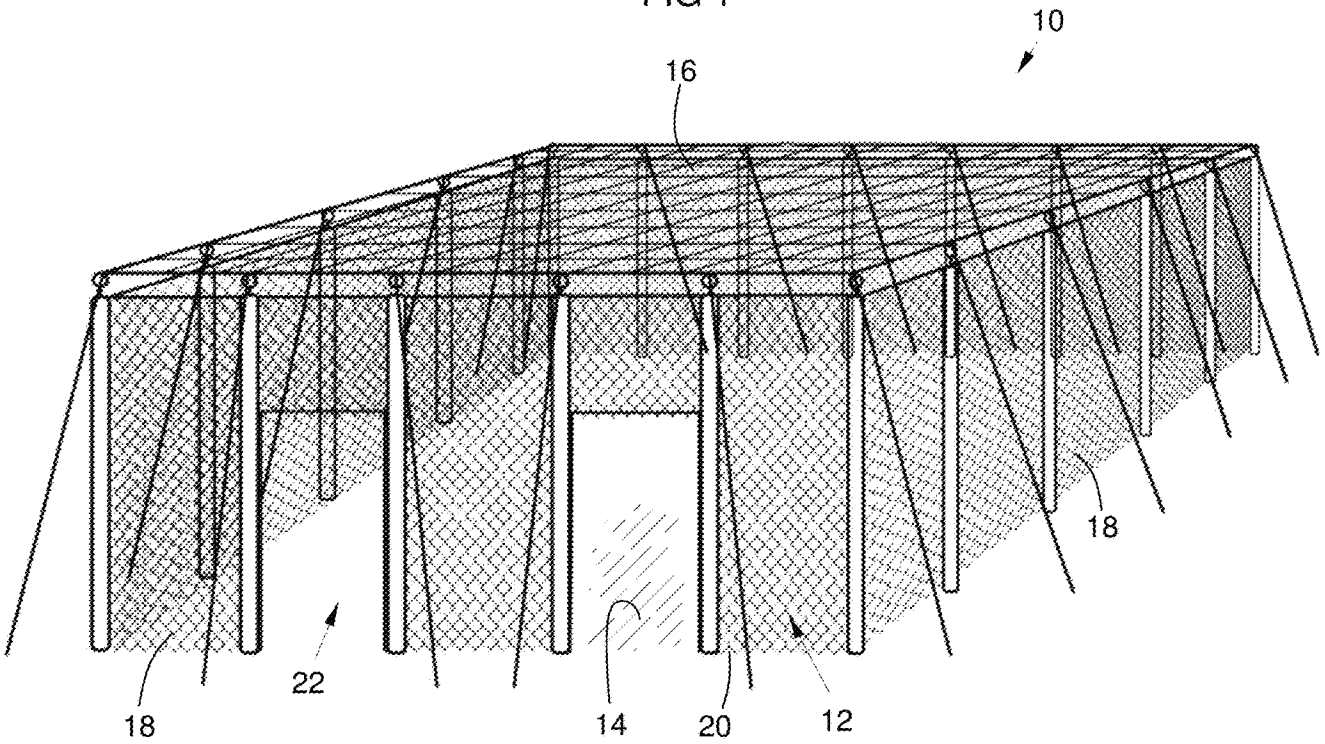
FIG. 1 shows an enclosure constructed in accordance with aspects of the present enclosed miniature disc-golf court.

FIG. 1 shows an enclosed miniature disc-golf court 10 for playing a miniature disc-golf game. The enclosed miniature disc-golf court 10 includes an enclosure 12 having a floor 14 and a ceiling 16 overlying the floor 14. At least three walls 18 or an endless loop wall (not shown) extend between perimeter edges 20 of the floor 14 and the ceiling 16 to thereby define an enclosed area 22 between the floor 14 the ceiling 16 and the walls 18.

Figure 2:
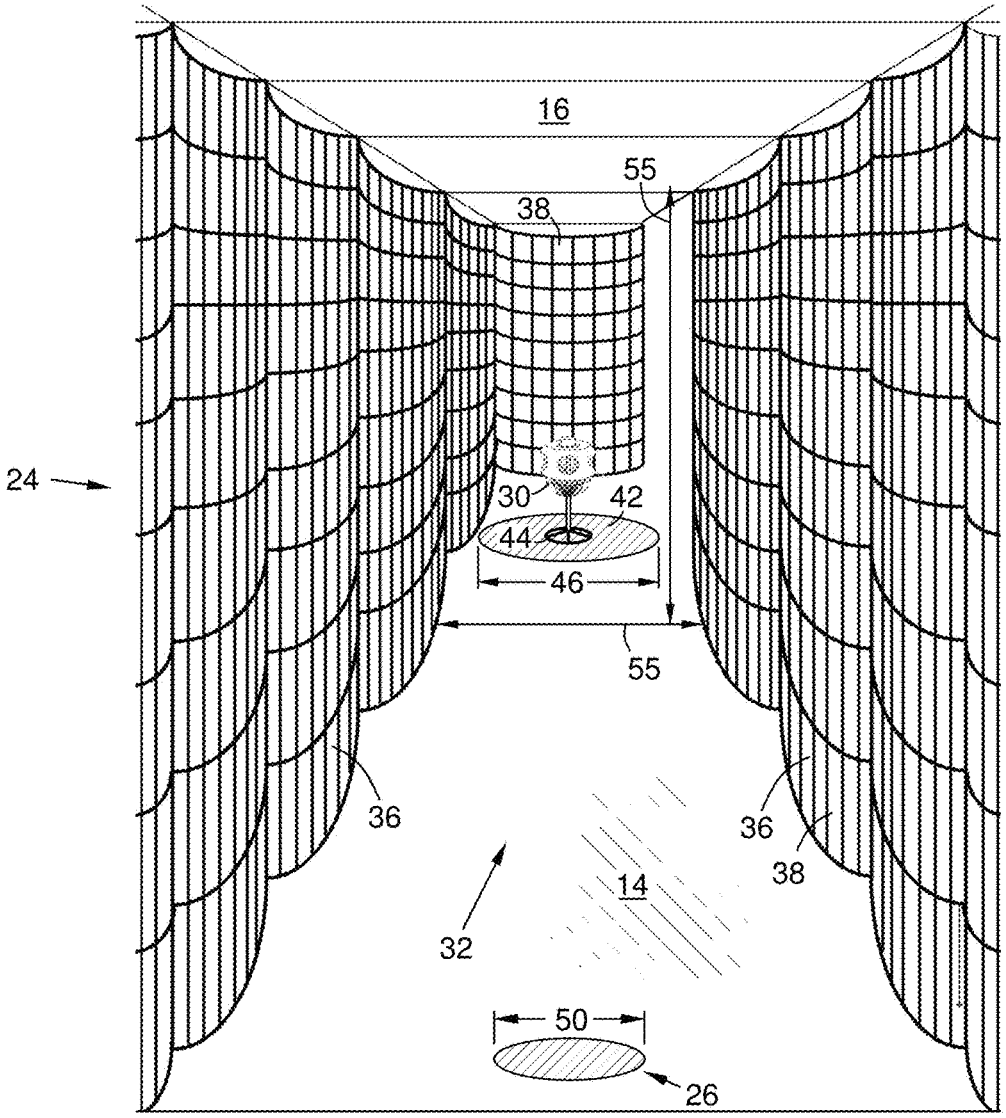
FIG. 2 shows a miniature disc-golf hole including a tee-off area, a lane, and a target-basket, wherein the hole is surrounded by boundaries extending from a floor up towards a ceiling of the enclosure over the hole.

FIG. 2 shows an exemplary miniature disc-golf hole 24. A plurality (not shown) of disc-golf holes 24 are defined within the enclosure 12 (FIG. 1). Each disc-golf hole 24 includes a tee-off area 26 for launching a disc 28 (FIG. 3), a target-basket 30 for receiving the disc 28, and a lane 32 defined between the tee-off area 26 and the target-basket 30 so that a player hand throws or flies the disc 28 from the tee-off area 26 and along or over the lane 32 toward the target-basket 30. Also, within the enclosure 12, each disc-golf hole 24 is separated from each other disc-golf hole (not shown) by boundary walls 36 extending from the floor 14 to at least eighty percent of a distance from the floor 14 to the ceiling 16. The boundary walls 36 are configured to prevent passage of a disc 28 through the boundary walls 36. In other words the boundary walls 36 may be made of suspended nets having openings 38 narrower than a diameter 40 (FIG. 4) of the disc 28. A disc flight obstacle may be disposed across a vertical cross section 55 of the lane 32 as later described.

The walls 18 of the enclosure 10 (FIG. 1) may be made of semi-rigid fencing, especially for outdoor usage, while the ceiling 16 and boundaries 36 may be formed from flexible netting material. The walls 18, floor 14, ceiling 16 and boundaries 36 between the holes 24 may be made of any material that will permit playing the game of miniature disc-golf as described herein.

The enclosed miniature disc-golf court 10 also includes a target pad 42 secured to the floor 14 between a base 44 of the target-basket 30 and the floor 14. The target-basket 30 is secured to, or rests upon, a middle of the target pad 42. The target pad 42 may be circular with a diameter 46 that is between about four times and about six times a largest horizontal diameter of the target-basket 30.

The enclosed miniature disc-golf court 10 may also include the tee-off area 26 being a circular tee-off area having a diameter 50 that is about the same as a largest horizontal diameter of the target-basket 30.

Figure 3:
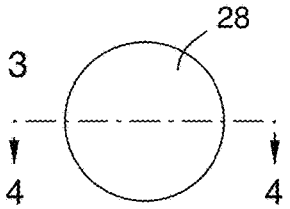
FIG. 3 is a top plan view of a miniature disc, or mini-disc, appropriate for use in the enclosed miniature disc-golf court.

FIG. 3 is a top plan view of a miniature disc, or mini-disc, appropriate for use in the enclosed miniature disc-golf court.

Figure 4:
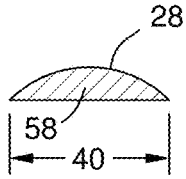
FIG. 4 is a vertical cross-section of the disc taken along line 4-4 of FIG. 3.

FIG. 4 is a vertical cross-section of the disc taken along line 4-4 of FIG. 3.

Figure 5A:
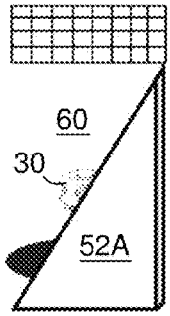
FIGS. 5A-5N show embodiments of disc flight obstacles that may be positioned within a lane between a tee-off area and a target-basket of a miniature disc-golf course in accordance with aspects of an embodiment of the invention.
Figure 5B:
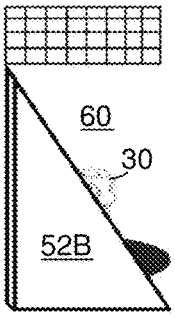
Figure 5C:
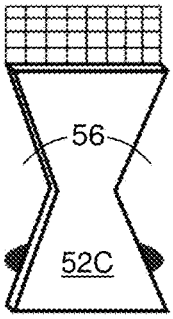
Figure 5D:
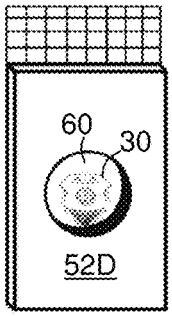
Figure 5E:
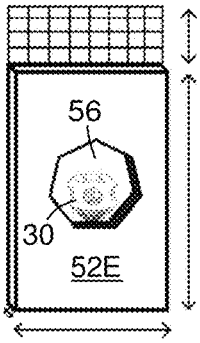
Figure 5F:
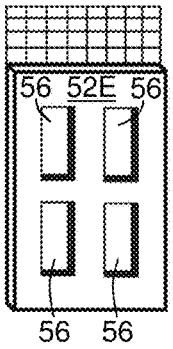
Figure 5G:
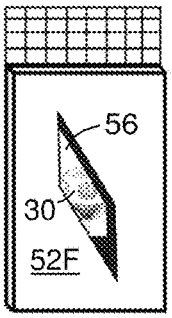
Figure 5H:
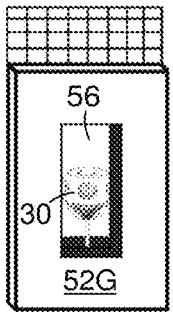
Figure 5I:
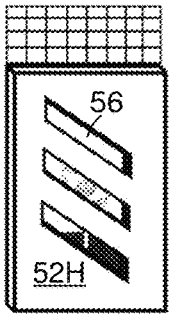
Figure 5J:
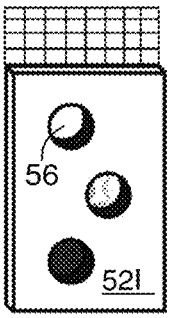
Figure 5K:
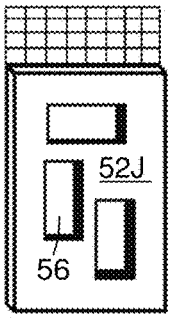
Figure 5L:
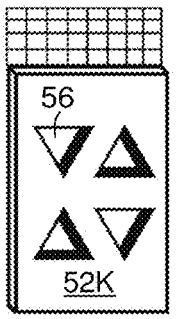
Figure 5M:
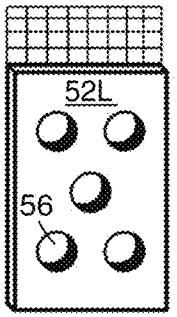
Figure 5N:
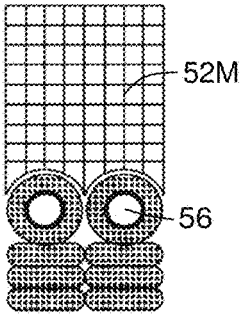

FIGS. 5A-5M show a variety of forms of disc flight obstacles 52A-M. At least one hole 24 of the golf court 10 may be provided with an obstacle between the tee-off area 26 and the target-basket. For example, the obstacle 52E of FIG. 5E may be positioned within the lane 32 of the hole 24 between the tee-off area 26 and the target-basket 30 (FIG. 2). The obstacle blocks passage of the disc 28 through between about fifty percent and about ninety-five percent of an area of a vertical cross-section of the lane 32 as illustrated by horizontal and vertical guide lines 55 in FIG. 2. Each obstacle 52A-M may comprise either a single unblocked area 60 providing a passageway through and/or around the obstacle or a plurality of unblocked areas 56 providing passageways through and/or around the obstacle. Each unblocked area 56, 60 may have an area greater than about two times the area 58 (FIG. 4) of a vertical cross-section of the disc 28, and is configured to permit passage of the disc 28 through or around the obstacle.

Figure 6:
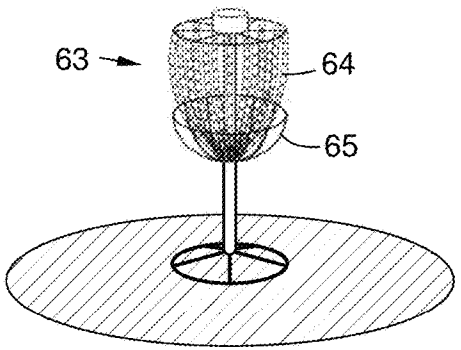
FIG 6 Prior Art
FIG. 6 shows a conventional big disc-golf target-basket.

FIG. 6 shows a conventional disc-golf target-basket 63 with chains 64 to decelerate the disc so it drops into a collector 65.

Figure 7:
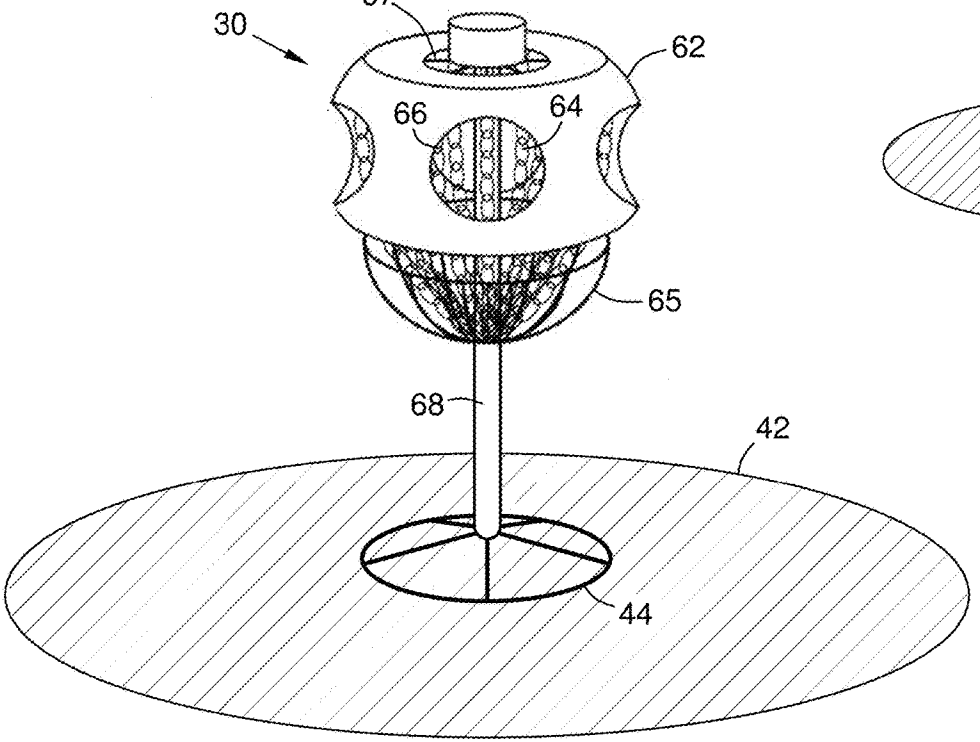
FIG. 7 shows a target-basket with a disc-access sleeve in accordance with aspects of an embodiment of the invention

FIG. 7 shows a disc-golf target-basket 30 with aspects of an embodiment of the invention. It includes a disc collector 65 mounted on a pole 68, and deceleration chains 64 hanging from a hanger array 67 at the top of the pole 68 toward the disc collector 65. A disc-access sleeve 62 surrounds an area above the collector, blocking access of a thrown disc to the collector except via disc entry passages 66 in the sleeve. Each disc-access entry passage 66 is configured to permit passage of the disc 28 through the passage 66 so that the disc 28 passing through the passage 66 is captured within the target-basket 30 to complete playing of a hole 24 by the player that directed the disc 28 through the entry passage 66. Each of the entry passages 66 defines an unobstructed area at least large enough for the disc 28 to pass through, and may define an unobstructed area of between about one-hundred and fifty percent and about two hundred percent of an area 58 of a vertical cross-section of the disc 28.

In particular embodiment of the enclosed miniature disc-golf court 10, nine or eighteen disc-golf holes 24 may be defined within the enclosure 12. In another aspect of the enclosed miniature disc-golf court 10, at least twelve of the disc-golf holes include an obstacle 52A-M positioned within the lane 32 between the tee-off area 26 and the target-basket 30. Each of the obstacles partially blocks passage of the disc 28, thus requiring skill to miss the obstacle and land the disc in the collector 65 of the target-basket 30. In another embodiment of the enclosed miniature disc-golf court 10, the area of the floor 14 of the enclosed miniature disc-golf court 10 may be about seven thousand square feet and optionally greater than seven thousand square feet.

To play, a player stands at the teeing-off circle, and throws a disc, trying to fly it through or around an obstacle 52A-M to the target-basket 30. If the disc does not enter the target-basket, additional attempts may be made from where the disc lands until the disc is in the target-basket. Rules regarding player stance and motions, and regarding throwing from a disc lie in the target pad may be provided. Attempts to fly the disc into the target basket are counted up to a maximum allowable number of attempts per player per hole. The lowest score among multiple players wins a hole or a round. A hole may have an obstacle 52A-M and/or a disc-access sheath 62 on at least some holes 24 of a court 10. Specific dimensions and materials for court equipment may be established relative to rules of play. For example, the target pad 42 may have a diameter of 5 feet, and when a disc lands on the target pad a particular throwing position, stance, and motion may be required for the next shot.

While various embodiments of the present invention have been shown and described herein, such embodiments are provided by way of example only. Changes and substitutions may be made without departing from the invention herein. Accordingly, it is intended that the invention be limited only by the intended meaning and scope of the appended claims.

The invention claimed is:

1. An enclosed miniature disc-golf court for playing a miniature disc-golf game, the enclosed miniature disc-golf court comprising:

a) an enclosed court having a floor, a ceiling overlying the floor, and at least three walls or an endless loop wall extending between perimeter edges of the floor and the ceiling to thereby define an enclosure between the floor the ceiling and said at least three walls or the endless loop wall;

b) a plurality of disc-golf holes within the enclosure, wherein each disc-golf hole includes a tee-off area for launching a disc, a target-basket, and a lane defined between the tee-off area and the target-basket so that a player flies the disc from the tee-off area along the lane toward the target-basket;

c) wherein the target-basket comprises a disc-access sleeve surrounding the target-basket, wherein the disc-access sleeve comprises a plurality of disc-access through-passages, each of the disc-access through-passages defining an entry opening that permits passage of the disc through the entry opening into the target-basket, and wherein each of the entry openings defines an entry area greater than about one-hundred and fifty percent of a vertical cross-section of the disc; and, d) wherein each disc-golf hole is separated from each other disc-golf hole by boundary walls extending from the floor to at least eighty percent of a distance from the floor to the ceiling, and wherein the boundary walls are configured to prevent passage of a disc through the boundary walls.

2. The enclosed miniature disc-golf court of claim 1, further comprising a circular target pad secured adjacent the floor and between the target-basket and the floor so that the target-basket is secured adjacent a middle of the circular target pad, and the circular target pad has a diameter that is between about four times and about six times a largest horizontal diameter of the target-basket.

3. The enclosed miniature disc-golf court of claim 1, wherein the tee-off area is a circular tee-off area having a diameter that is about the same as a largest horizontal diameter of the target-basket.

4. The enclosed miniature disc-golf court of claim 1, wherein at least one of the plurality of disc-golf holes comprises an obstacle that partially blocks flight of the disc from the tee-off area to the target-basket, the obstacle comprising a passageway for the disc to fly through or around the obstacle.

5. The enclosed miniature disc-golf court of claim 1 wherein at least one of the plurality of disc-golf holes comprises an obstacle positioned within the lane between the tee-off area and the target-basket, wherein the obstacle blocks passage of the disc over between about fifty percent and about ninety-five percent of an area of a vertical cross-section of the lane, leaving a passageway for the disc to fly to the target-basket, the passageway having an area greater than about two times an area of a vertical cross-section of the disc.

6. The enclosed miniature disc-golf court of claim 5, wherein the obstacle comprises a plurality of passageways for the disc to fly through or around the obstacle to the target-basket.

7. The enclosed miniature disc-golf court of claim 1, wherein each of the entry openings in the disc-access sleeve defines an entry area between about one-hundred and fifty percent and about two-hundred percent of a vertical cross-section of the disc.

8. The enclosed miniature disc-golf court of claim 1, wherein the disc-golf court comprises nine or eighteen disc-golf holes.

9. The enclosed miniature disc-golf court of claim 1 comprising eighteen disc-golf holes, wherein each of at least twelve of the disc-golf holes includes an obstacle positioned within the lane between the tee-off area and the target-basket, and wherein each of the obstacles block passage of the disc through between about fifty percent and about ninety-five percent of an area of a vertical cross-section of the lane, leaving an unblocked area of the vertical cross-section that is about two times an area of a vertical cross-section of the disc.

10. The enclosed miniature disc-golf court of claim 9, wherein at least one of the obstacles defines a plurality of passageways for the disc to fly through the obstacle from the tee-off area to the target-basket.

11. The enclosed miniature disc-golf court of claim 1, wherein the area of the floor of the enclosed miniature disc-golf court is about seven thousand square feet or is greater than about seven thousand square feet.

12. A method of using the enclosed miniature disc-golf court of claim 5 comprising the steps of;

a) a user standing at the tee-off area of said at least one of the golf holes and manually launching a disk toward the target-basket thereof in an attempt to fly the disc through the passageway around or through the obstacle to the target-basket;

b) if the disc does not enter the target-basket, the user then stands where the disc landed, and manually launces it in another attempt to hit the target basket;

c) repeating step b until the disc enters the target-basket or until a maximum number of attempts is reached;

d) counting the attempts by the user to fly the disc into the target basket; and e) comparing the number of attempts at the target-basket by said user against a number of attempts by another user to reach the target basket at said at least one of the golf holes.

13. A disc-golf target-basket comprising:

a disc collector mounted on a pole;

a disc deceleration device disposed between a top of the pole and the disc collector;

a sleeve mounted on the pole above the disc collector and around the deceleration device, wherein the sleeve blocks entry of a thrown disc into the disc collector except via a disc entry passage in a side of the sleeve.

14. The disc golf target-basket of claim 13, further comprising a throwing disc, wherein the disc entry passage defines an unblocked area in the sleeve of between about one hundred and fifty percent and about two hundred percent of an area of a vertical cross-section of the throwing disc.

15. A method of using the enclosed miniature disc-golf court of claim 14 comprising the steps of;

a) a user manually launching the disk toward the target-basket in an attempt to fly the disc through the disc entry passage in the sleeve;

b) if the disc does not enter the target-basket, the user then stands where the disc landed, and manually launches it in another attempt to enter the target basket;

c) repeating step b until the disc enters the target-basket or until a maximum number of attempts is reached;

d) counting the attempts by the user to fly the disc into the target basket; and e) comparing the number of attempts at the target-basket by said user against a number of attempts by another user to enter a second disc into the target basket.

* * * * *